US006241478B1

(12) United States Patent
Cichetti et al.

(10) Patent No.: US 6,241,478 B1
(45) Date of Patent: Jun. 5, 2001

(54) COMBINED AIR MOVING PRODUCT ILLUMINATED PANEL AND DEVICE

(75) Inventors: Michael Cichetti; William E. Lasko, both of West Chester, PA (US)

(73) Assignee: Lasko Holdings INC, West Chester, PA (US)

( * ) Notice: Subject to any disclaimer, the term of this patent is extended or adjusted under 35 U.S.C. 154(b) by 0 days.

(21) Appl. No.: 09/345,351

(22) Filed: Jul. 1, 1999

(51) Int. Cl.[7] ..... F04B 49/00
(52) U.S. Cl. ..... 417/63; 340/908.1
(58) Field of Search ..... 62/125; 417/63, 417/234, 18; 165/12; 340/908.1, 825.06; 395/835

(56) References Cited

U.S. PATENT DOCUMENTS 4,240,264 * 12/1980 Nakada et al. ..... 62/125
4,336,001 * 6/1982 Andrews et al. ..... 417/63
4,386,649 * 6/1983 Hines et al. ..... 165/12
4,483,664 * 11/1984 Armbruster ..... 417/234
4,789,310 * 12/1988 Hung ..... 417/234
4,954,049 * 9/1990 Armbruster ..... 417/234
5,257,020 * 10/1993 Morse ..... 340/908.1
5,269,660 * 12/1993 Pradelle ..... 417/18
5,520,519 * 5/1996 Birkrland ..... 417/63
5,528,229 * 6/1996 Mehta ..... 340/25.06
5,649,808 * 7/1997 Gruszecki et al. ..... 417/63
5,835,786 * 11/1998 Brown et al. ..... 395/835

* cited by examiner

*Primary Examiner*—Teresa Walberg
*Assistant Examiner*—Leonid Fastovsky
(74) *Attorney, Agent, or Firm*—Zachary T. Wobensmith, III

(57) ABSTRACT

A combined air moving product illuminated panel and device which has a base and a housing, which housing contains a motor and blades for moving air, which product has a device mounted in the housing, with an electroluminescent panel mounted behind and in contact with the device, to indicate, its location, and to illuminate its display.

10 Claims, 2 Drawing Sheets

COMBINED AIR MOVING PRODUCT ILLUMINATED PANEL AND DEVICE

BACKGROUND OF THE INVENTION

FIELD OF THE INVENTION

This invention relates to a combined air moving product, illuminated panel situated and device, of the type that has an electroluminescent panel behind the device, to illuminate the device to show its location, and/or to illuminate its display.

DESCRIPTION OF THE PRIOR ART

Air moving objects such as fans, which combine various separate features, are known in the the prior art. In the U.S. Pat. No. 4,424,006 to Armbruster a combined power device, light and fan is described, which in essence is a portable fan equipped with an electric outlet and a light.

In the U.S. Pat. No. 4,483,664 to Armbruster a combined portable power device, light and fan is described which is similiar to the '006 patent but which provides for pivotal movement of a portion of the housing for air directon.

In our prior patent application Ser. No. 09/307,844 filed May 10, 1999 entitled "Illuminated Controls For Air Moving Products" a conventional fan and humidifier is disclosed, wherein an electroluminescent panel is used to illuminate various controls, such as the thermostat, motor speed, or humidistat to show their location and or setting.

While the electroluminescent panel was described for use with

While the electroluminescent panel was described for use with conventional controls in air moving products such as temperature control, humidity control, or motor speed control, no structure was described which included or suggested the combination of an air moving product with an electroluminesent panel, and a device, with the panel locating, and illuminating the device's display.

SUMMARY OF THE INVENTION

It has now been found that a combined air moving product which includes an electroluminescent panel and a device, such as a clock is available, which panel indicates the location, and iluminates the time display of a device on the air moving product.

The principal object of the indication is to provide a combined air moving product, which has an electroluminesent panel and a device, which panel illuminates the device to indicate the location of the device and/or its display.

A further object of the invention is to provide a combined air moving product of the character aforesaid that is useful for a wide variety of air circulating products.

A further object of the invention is to provide a combined air moving product of the character aforesaid that is simple and inexpensive to construct, but sturdy, reliable, and long lasting in operation.

A further object of the invention is to provides a combined air moving product of the character aforesaid that provides excellent visibility of the device, and its display, but is unobtrusive to the user.

A further object of the invention is to provide a combined air moving product of the character aforesaid, which is inexpensive to operate.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
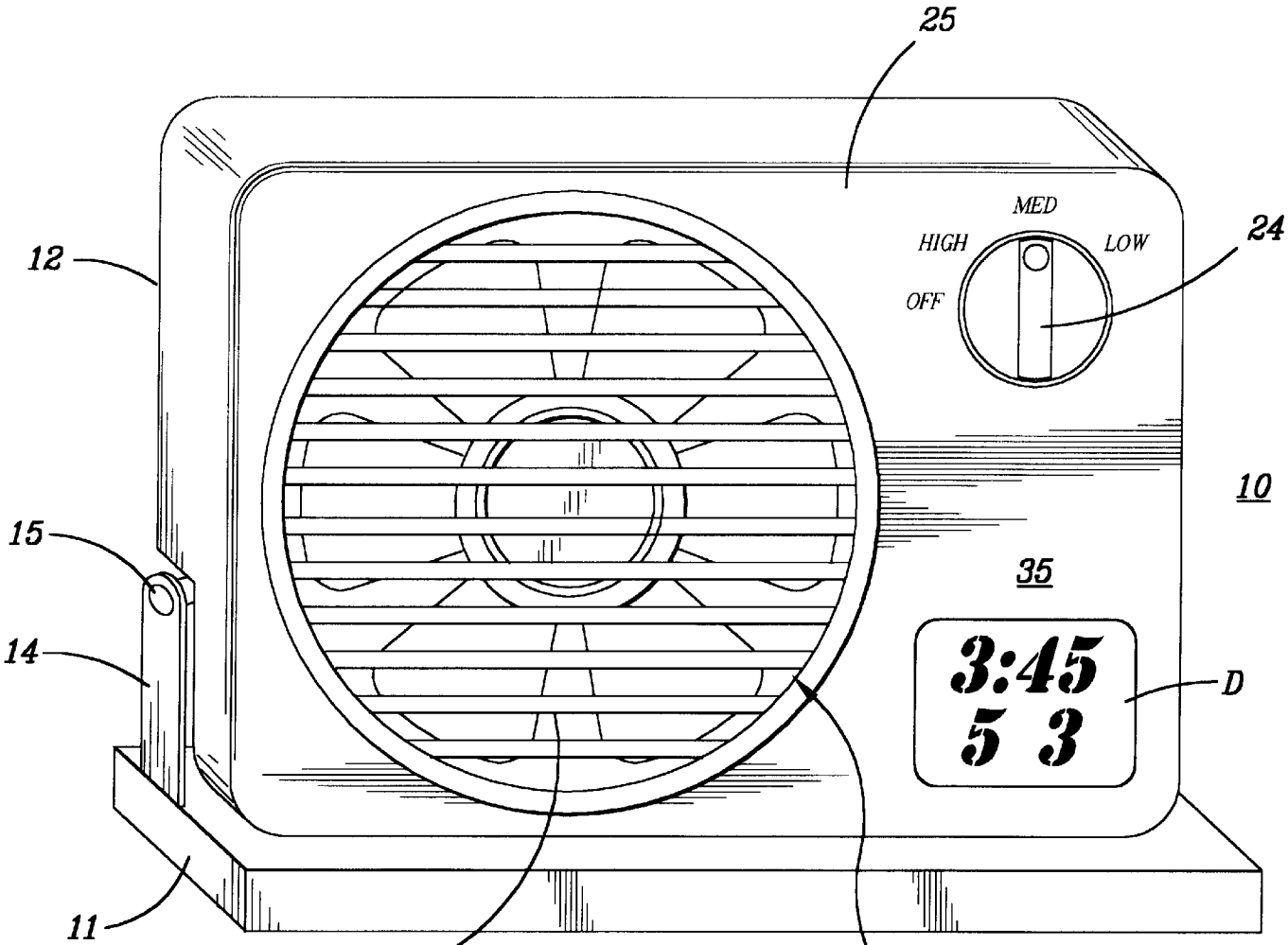
FIG. 1 is a front view of one embodiment of the invention which is a fan incorporating the electroluminescent panel and a clock.

Referring now more particularly to FIG. 1 of the drawings, one embodiment of the invention is illustrated which is a desk fan 10. The fan 10 includes a base 11, with an outer fan housing 12 connected to the base 11 by vertical plate 14 and bolt 15, to permit the housing 12 to pivot, to change the direction of the air flow.

Figure 2:
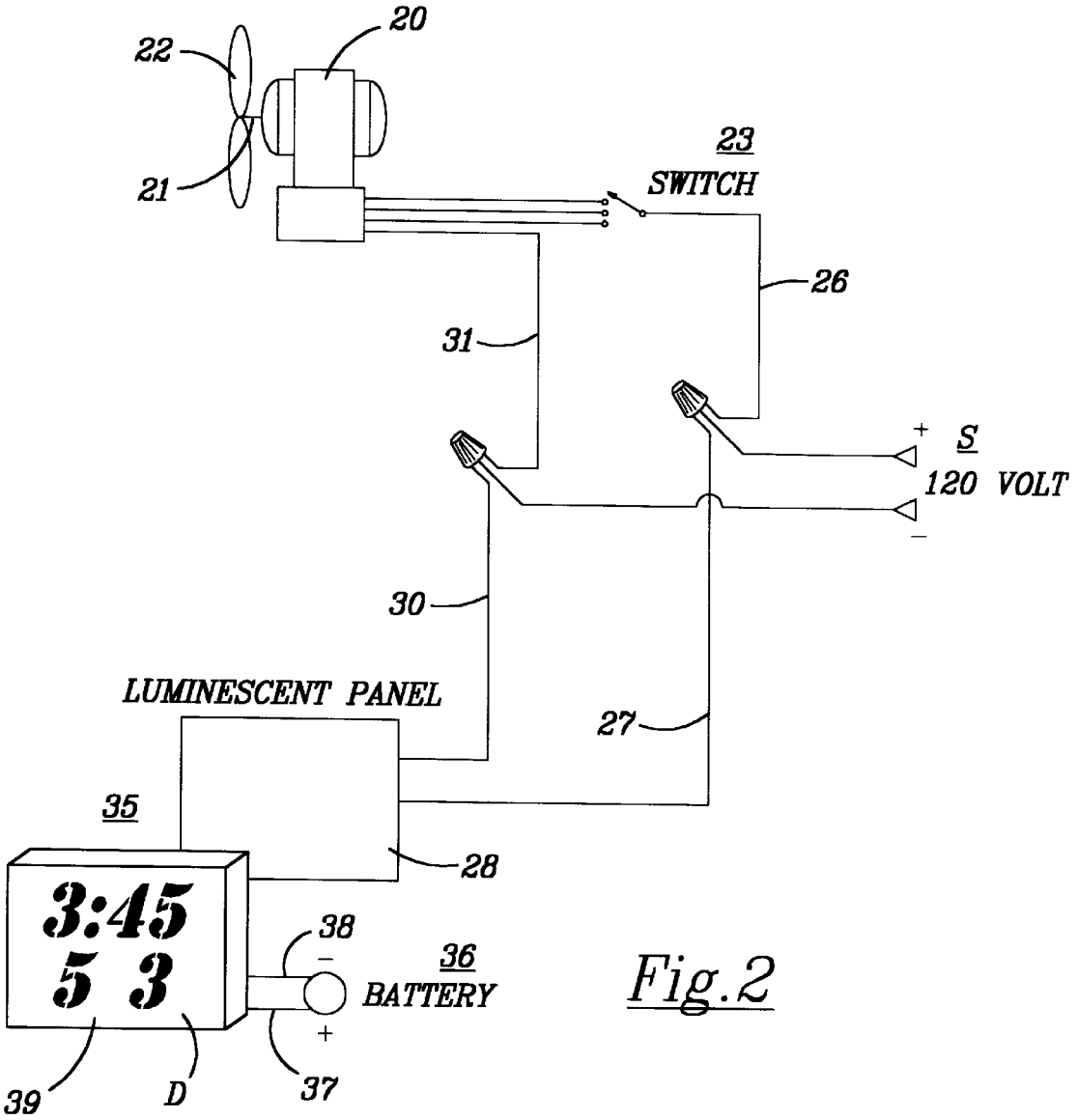
FIG. 2 is a diagrammatic view of the components of the fan of FIG. 1.

The housing 12 has a circular opening 16 with a grill 17 therein. Referring additionally to FIG. 2, the fan 10 has a fan motor 20, with a fan blade 21 attached to a shaft 22, extending from the fan motor 20.

A multi-position switch 23 is provided, with a knob 24 and indicia on the front panel 25 of housing 12, to indicate the position of switch knob 24 and the speed of the fan motor 20, The switch 23 is connected by wire 26 to the positive side of a source of electrical energy S which may be 120 volts A.C.

The wire 26 has a wire 27 connected thereto and to one side of an electroluminescent panel 28, which is of electroluminescent film.

The panel 28 is available from Jinxin Chemical Electronic Instruments Co. LTD of Shenzhen, China. The panel 28 includes a thin flexible lightweight substrate (not shown) of electroluminescent material, with a thin transparent protective cover (not shown) thereon of well known type. The panel 28 is connected by a wire 30 to the other side of the electrical energy source S, which is also connected to the fan motor 20 by a wire 31. connected to a battery 36 by wires 37 and 38 which energize the clock time display D.

The device 35 could also be a temperature control in a fan or a speed control, or a temperature, or time display in a range hood, or a heater, or a humidistat or other control as required.

The clock 35 has a front face 39, which has a numerical time and date display D thereon.

The panel 28 is mounted directly behind, and is in close proximity contact with clock 35 to provide for illumination of the clock, to provide its location and also to illuminate the display D.

It will thus be seen that structure has been provided with which the objects of the invention are obtained.

What is claimed is:

1. In combination with a portable air moving product which has a motor and blades for moving air, which may be connected to a source of electrical energy, said product having a base, the improvement which comprises a device carried in said housing which has a display, an electroluminescent panel mounted behind and in close proximity to said device, said electroluminescent panel is connected to said electrical energy source, and said panel illuminates said device to show its location on the product, and its display.

2. An air moving product as defined in claim 1 wherein said air moving product is a fan.

3. An air moving product as defined in claim 1 wherein said air moving product is a humidifier.

4. An air moving product as defined in claim 1 wherein said air moving product is a heater.

5. an air moving product as defined in claim 1 in which said air moving product in a range hood.

6. An air moving product as defined in claim 1 wherein said device is a clock.

7. The air moving product as defined in claim 6 wherein said device is connected to an electric storage battery.

8. An air moving product as defined in claim 3 wherein said device indicates humidity.

9. An air moving product as defined in claim 1 wherein said device indicates temperature.

10. An air moving product as defined in claim 1 wherein said device indicates speed.

* * * * *